United States Patent [19]

Peters

[11] Patent Number: 4,951,939

[45] Date of Patent: Aug. 28, 1990

[54] EXERCISE MACHINE

[76] Inventor: Dale W. Peters, 25761 Rose Rd., West Lake, Ohio 44145

[21] Appl. No.: 255,319

[22] Filed: Oct. 11, 1988

[51] Int. Cl.[5] ..... A63B 21/06

[52] U.S. Cl. ..... 272/117; 272/55; A63B/21/06

[58] Field of Search ..... 272/93, 117, 118, 116, 272/134, 143, 55, 119

[56] References Cited

U.S. PATENT DOCUMENTS

| | | | |
|---|---|---|---|
| 1,577,037 | 3/1926 | Kochler | 272/55 |
| 2,050,500 | 8/1936 | Osborn | 272/55 X |
| 2,932,509 | 4/1960 | Zinkin . | |
| 3,010,720 | 11/1961 | Allard | 272/117 |
| 3,116,062 | 12/1963 | Zinkin . | |
| 3,475,024 | 10/1969 | Lewis | 272/117 |
| 4,018,435 | 4/1977 | Howell | 272/55 |
| 4,109,908 | 8/1978 | Pugh et al. | 272/119 |
| 4,211,403 | 7/1980 | Coffaro et al. . | |
| 4,339,124 | 7/1982 | Vogler | 272/117 |
| 4,546,970 | 10/1985 | Mahnke . | |
| 4,582,320 | 4/1986 | Shaw | 272/143 |
| 4,598,907 | 7/1986 | Ross | 272/117 |
| 4,623,144 | 11/1986 | Rockwell . | |
| 4,645,205 | 2/1987 | Wolff . | |
| 4,647,041 | 3/1987 | Whiteley | 272/134 |
| 4,765,611 | 8/1988 | MacMillan | 272/118 |
| 4,779,864 | 10/1988 | Henson | 272/117 |
| 4,838,545 | 6/1989 | Wilson | 272/117 |

*Primary Examiner*—Robert W. Bahr

*Attorney, Agent, or Firm*—Weston, Hurd, Fallon, Paisley & Howley

[57] ABSTRACT

An exercise machine includes a lever in the form of an elongate board that is supported for pivotal movement by a fulcrum disposed at or near the center of the board. Weights are connected to one end of the board, while a handle is attached to the other end of the board. The fulcrum is connected to a base in the form of a pair of spaced, parallel runners to which a seat can be connected. The machine permits a variety of "pull-down, push-down" exercises to be performed.

19 Claims, 4 Drawing Sheets

EXERCISE MACHINE

BACKGROUND OF THE INVENTION

1. Field of the Invention

The invention relates to exercise machines and, more particularly, to an exercise machine employing a pivotally mounted lever.

2. Description of the Prior Art

In recent years there has been an increased awareness of physical fitness on the part of the populace. Physical fitness activities such as jogging, swimming, and weight lifting have seen tremendous increases. As the interest in physical fitness activities has increased, the market for exercise-related equipment, particularly exercise machines, also has increased.

Exercise machines can be divided into two broad categories—commercial machines usually employed by organizations such as fitness clubs, and consumer machines suitable for use at home. Commercial machines often are single-purpose, that is, suitable for exercising only certain muscles, whereas consumer machines often are multi-purpose, that is, suitable for exercising different groups of muscles. Because commercial machines are subjected to hard use, and because commercial establishments can afford to have specialized equipment, exercise machines used in such facilities are quite durable and are usually relatively expensive. On the other hand, consumer machines cannot be too expensive even though they must be able to provide a wide range of exercises. These constraints have limited the quality of consumer exercise machines and, it is believed, the effectiveness of such machines.

A typical consumer exercise machine employs a vertically extending frame that has a variety of attachments, or stations, connected to it. A bench usually extends from the frame and various levers and pulleys enable the user to move a resistance in order to perform different exercises. Most of the exercises available with typical consumer exercise machines consist of the so-called "push-up, pull-up" variety. That is, the user must raise a lever, either by pushing it from below or pulling it from above, in order to properly use the machine.

Although "pull-down, push-down" consumer exercise machines are known, they usually employ a very large and high frame. A cross bar or handle is connected to a resistance by means of a cable passing over a pulley. By their very nature, these machines are quite large and, although they are capable of performing many exercises, they have various limitations. In particular, these machines do not adequately address the problem of exercising the muscles of the back and abdomen.

Desirably, a consumer exercise machine would provide good all-around exercise as well as exercises especially intended for the muscles of the back and abdomen. Such a machine preferably would be more compact and durable than existing consumer exercise machines; also, it hopefully would be less expensive than existing consumer exercise machines.

SUMMARY OF THE INVENTION

In response to the foregoing concerns, the present invention provides a new and improved exercise machine especially adapted for consumer use but which has features often associated only with commercial exercise machines. The exercise machine according to the invention includes an elongate lever, preferably in the form of a board defining a longitudinal axis and having first and second ends. A fulcrum supports the board at a location intermediate the first and second ends. Weights, typically in the form of conventional bar bell plates, are disposed adjacent the first end of the board. A handle is disposed at the second end of the board for enabling the user to raise and lower the second end of the board.

In the preferred embodiment of the invention, the fulcrum is in the form of spaced, vertically extending members disposed on either side of the board and a laterally extending bar connecting the vertically extending members. The board rests atop the laterally extending bar. Spaced, parallel runners are connected to the base and are disposed parallel to the longitudinal axis of the board. A movable seat can be attached to the runners in a variety of positions. In addition, a hold down bar is provided that clamps the first end of the board into a locked position relative to the runners. When the board is locked in this position, a second handle can be attached to the second end of the board. The second handle extends the effective length of the board and permits different types of exercises to be performed.

The exercise machine according to the invention is compact and durable. It enables a wide variety of exercises to be performed, particularly exercises that benefit the muscles of the back and abdomen. A significant advantage of the present invention is that it is exceedingly simple in construction and inexpensive. Accordingly, the invention has certain advantages of such more expensive commercial exercise machines, while retaining the versatility of consumer exercise machines.

The foregoing and other features and advantages of the invention are described in more detail in the accompanying specification and claims.

DESCRIPTION OF THE PREFERRED EMBODIMENT

Figure 1:
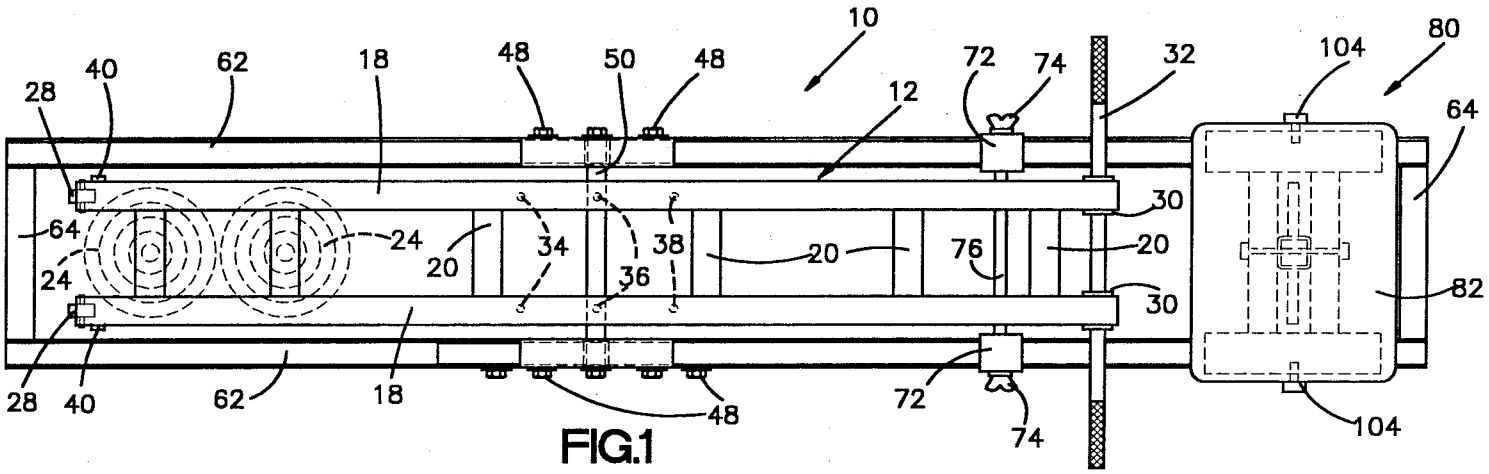
FIG. 1 is a top plan view of an exercise machine according to the invention.

Referring to the figures, an exercise machine according to the invention is indicated generally by the reference numeral 10. The machine 10 includes a lever in the form of an elongate board 12 defining a longitudinal axis and having a first end 14 and a second end 16. The board 12 includes a pair of spaced, parallel beams 18 connected by laterally extending braces 20. The braces 20 located closest to the end 14 each include a vertically extending post 22. Weights 24 usable with the machine 10 are indicated in FIGS. 1, 2, 6, and 7, and are disposed about the posts 22. Preferably, the weights 24 are in the form of conventional bar bell plates. Protective rubber or plastic screw-on caps 26 are fitted to the upper ends of the posts 22 in order to protect the user from the ends of the posts 22 and in order to hold the weights 24 in place on the board 12. From the foregoing description, it will be apparent that the posts 22 constitute a connecting means for connecting the weights 24 to the board 12.

The board 12 also includes a pair of wheels 28 connected to the beams 18 at the first end 14. The wheels 28 enable the board 12 to be moved conveniently from place to place. The second end 16 also includes aligned, laterally extending openings formed through the beams 18 and into which a pair of bushings 30 have been fitted. The bushings 30 receive a handle 32 in the form of a steel shaft. The handle 32 is disposed perpendicular to the longitudinal axis of the board 12. Spaced pairs of pins 34, 36, 38 project from the underside of the beams 18. The pins 36 are located at the center of the board 12; the pins 34 are located closer to the first end 14; and the pins 38 are located closer to the second end 16. The beams 18 also include aligned, laterally extending openings carrying bushings 40 at the first end 14 adjacent the wheels 28. The bushings 40 are adapted to receive the handle 32 for certain types of exercises.

Figure 2:
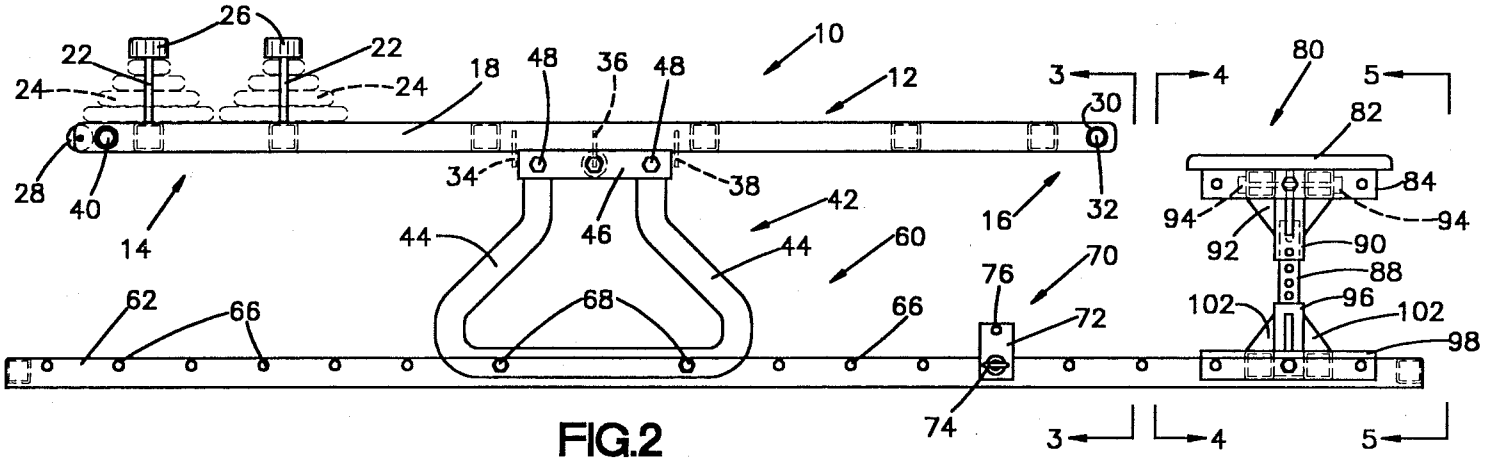
FIG. 2 is a side elevational view of the exercise machine of FIG. 1.
Figure 5:
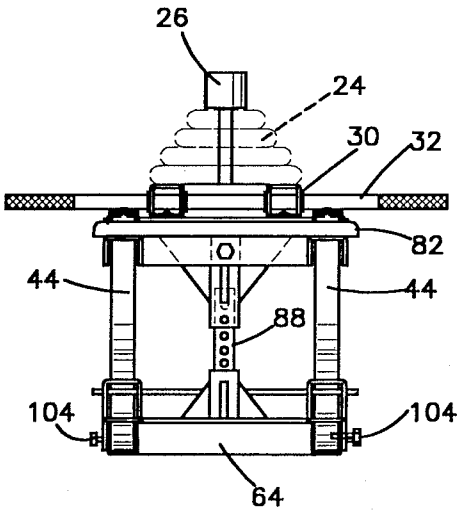
FIG. 5 is a view taken along a plane indicated by line 5—5 in FIG. 2.
Figure 4:
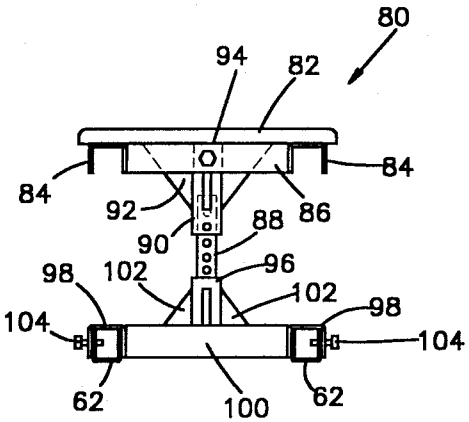
FIG. 4 is an end view of a seat employed with the exercise machine according to the invention taken along a plane indicated by line 4—4 in FIG. 2.
Figure 3:
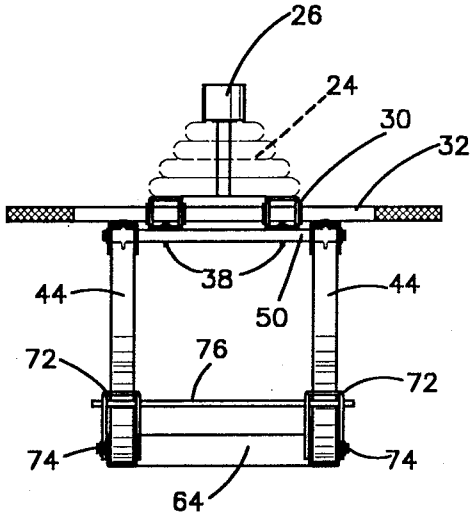
FIG. 3 is a view of the invention of FIG. 1 taken along a plane indicated by line 3—3 in FIG. 2.
Figure 6:
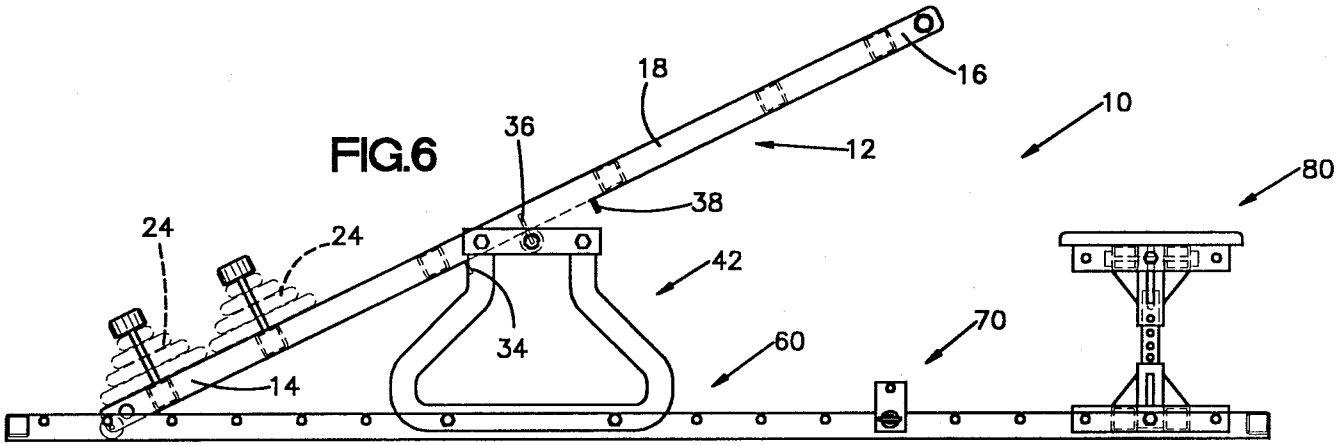
FIG. 6 is a view similar to FIG. 2 showing a board employed as part of the invention in a raised position.

The board 12 rests atop a fulcrum 42. The fulcrum 42 includes spaced, vertically extending members 44. The members 44, when viewed from the side as in FIG. 2, are connected at the bottom and form a generally triangular shape having an open apex. The apex is closed by a brace 46 that is connected to the upper end of the members 44 by means of bolted fasteners 48. A laterally extending bar 50 (FIGS. 1 and 3) connects the opposing braces 46. The bar 50 is supported in the braces 46 by bushings which permit the bar 50 to be pivoted about its longitudinal axis. The bar 50 includes spaced openings for receiving selected pairs of the pins 34, 36, 38. As can be seen in FIG. 1, the board 12 is narrower than the spacing between the vertically extending members 44. Accordingly, the beams 18 can be fitted between the members 44, and pivoting movement of the board 12 about the longitudinal axis of the bar 50 is permitted.

The fulcrum 50 is connected to a base 60. The base 60 is in the form of spaced, parallel runners 62. The runners 62 not only are parallel to each other, but also are disposed parallel to the longitudinal axis of the board 12. The runners 62 are joined at their ends by laterally extending braces 64. Laterally extending openings 66 are formed in the runners 62. The vertically extending members 44 are rigidly connected to the runners 62 by means of bolted fasteners 68 passing through selected openings 66. A so-called hold-down, or toe bar 70 also is provided for the runners 62. The toe bar 70 includes spaced formations 72 that are adapted to fit over the runners 62 and to be secured in place by spring-loaded pins 74. A laterally extending bar 76 connects the formations 72. As can be seen in FIG. 2, the bar 76 is spaced above the upper surface of the runners 62 a short distance. It is expected that the bar 76 will be vertically adjustable relative to the runners 62 by means of vertically extending slots (not shown) in the formations 72, or by any equivalent adjustment mechanism. The toe bar 70 can be connected to any of the openings 66 for purposes to be described subsequently.

The machine 10 includes a seat 80. The seat 80 has a planar, padded board 82. The board 82 as illustrated is relatively small, being suitable to support the user most comfortably in a seated position. It also is possible to provide the board 82 in a larger configuration to permit the user to lie on the board 82. A seat belt (not shown) also is included as part of the seat 80. The seat belt can be used to make certain that the user remains properly in place atop the seat 80, particularly when "pull-down" types of exercises are being performed. In the description that follows, it will be assumed that the user will use the seat belt as may be necessary.

Figure 8:
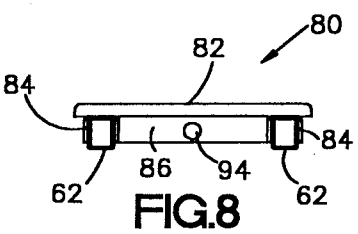
FIG. 8 is a view taken along a plane indicated by line 8—8 in FIG. 7.
Figure 7:
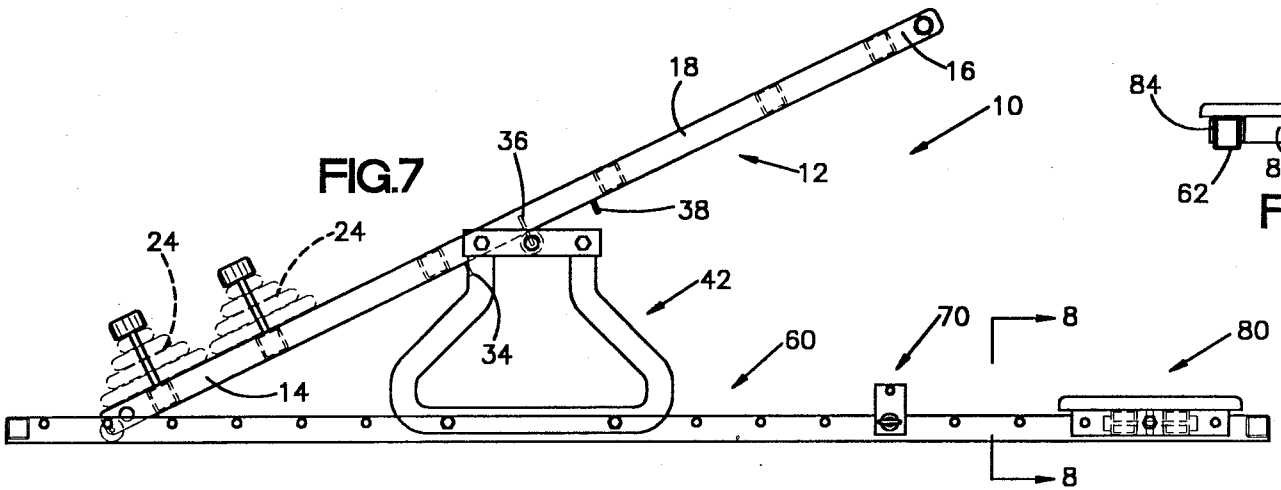
FIG. 7 is a view similar to FIG. 6 showing the seat in a lowered position.

The board 82 is secured to longitudinally extending channels 84 that are connected by laterally extending braces 86. The seat 80 is disposed atop a post 88. The post 88 includes plurality of vertically spaced openings. An upper sleeve 90 is fitted about the post 88 for telescopic movement relative thereto. The sleeve 90 includes an opening (not shown) through which a pin (not shown) can be inserted in order to adjust the position of the sleeve 90 relative to the post 88. The sleeve 90 is connected to the channels 84 and the braces 86 by gussets 92. Opposed, spring-loaded pins 94 extend through the braces 86 and engage the upper end of the sleeve 90. Upon retracting the pins 94, the board 82 can be removed from the sleeve 90 (FIG. 8).

The post 88 fits into a sleeve 96. The sleeve 96 is connected to channels 98 and braces 100 by means of gussets 102. The sleeve 96, channels 98, braces 100, and gussets 102 are substantially identical to the sleeve 90, channels 84, braces 86, and gussets 92 discussed earlier. The post 88, however, is rigidly secured within a lower sleeve 96 so as to be immovable therein. Spring-loaded pins 104 (shown schematically in the Figures) extend through the channels 98 to engage selected openings 66.

Figure 9:
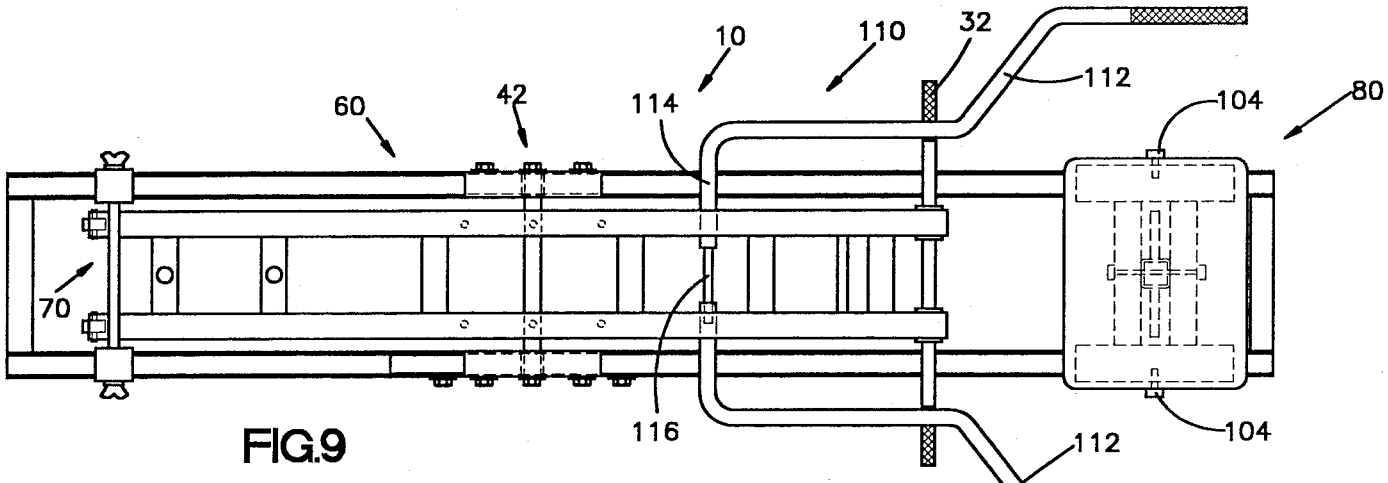
FIG. 9 is a plan view of the exercise machine of FIG. 1, showing the board in a raised position and an auxiliary handle in place.
Figure 10:
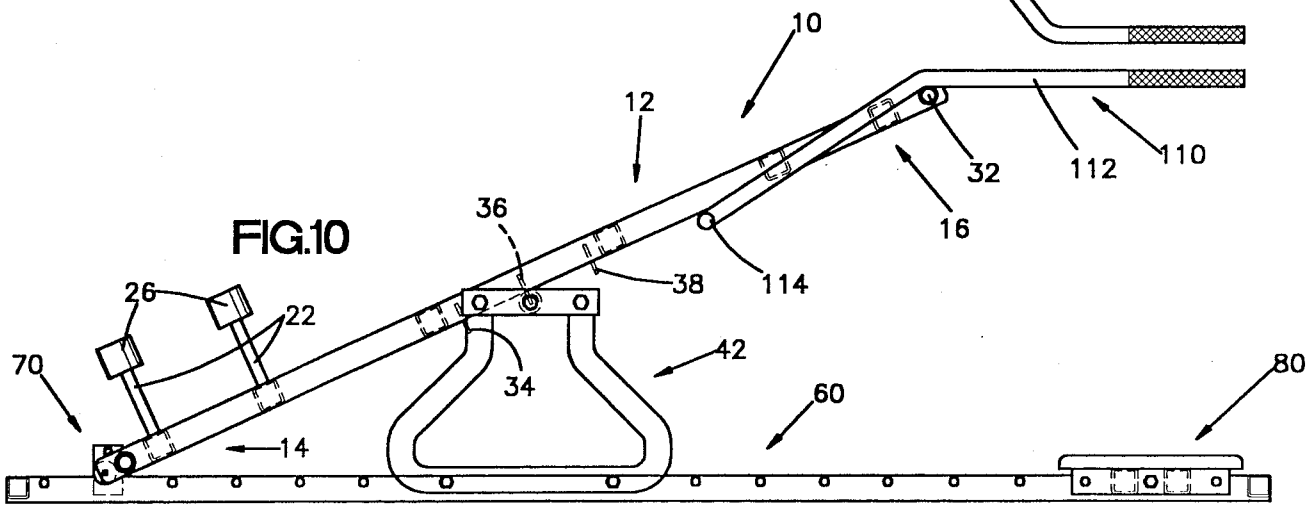
FIG. 10 is a side elevational view of the exercise machine shown in FIG. 9.

A second handle 110 is provided for the machine 10. Referring particularly to FIGS. 9 and 10, the handle 110 is a generally U-shaped structure that includes spaced arms 112 connected by a bight portion 114. Preferably, the handle 110 is defined by separate, mirror image arms 112 joined by a smaller connecting bar 116 that fits within the portion of the arms 112 defining the bight portion 114. As shown in FIG. 10, the bight portion 114 is adapted to rest underneath the board 12 while the arms 112 rest atop the handle 32. In this position, the arms 112 extend generally parallel to the longitudinal axis of the board 12.

OPERATION

The machine 10 permits a large number of exercises to be performed, particularly those of the "pull-down, push-down" variety. Although a wide variety of exercises can be performed, the machine 10 is especially effective in exercising the muscles of the back and abdomen.

The machine 10 is assembled and operated as follows:

1. The various components of the machine 10 are assembled to that configuration shown in FIGS. 106. When the weights 24 are placed on the posts 22, the board 12 will be moved to that position shown in FIG. 6, that is, the first end 14 will be adjacent the base 60, while the second end 16 will be elevated.

2. The user adjusts the vertical and horizontal positions of the toe bar 70 and then stands between the runners 62 with his toes under the toe bar 70. Then, grasping the handle 32, the user pushes the handle 32 toward the ground, thereby elevating the first end 14 (FIG. 2). This is a "push-down" exercise that provides particular benefits to the muscles of the back and abdomen. It is to be understood that this type of exercise can be performed with the seat 80 and it supporting structure completely removed from the base 60, and these exercises also can be performed without the use of the toe bar 70. The toe bar 70 is necessary when the force needed to lower the second end 16 exceeds the weight of the user.

3. The toe bar 70 also is used if the user wishes to perform certain leg exercises. Leg exercises can be performed in at least three ways: (a) by placing the toes under the toe bar 70 and squatting while firmly grasping the handle 32 at the second end 16; (b) by sitting on the second end 16, placing the toes under the toe bar 70 or the seat 80, and then pulling down with the leg muscles; and (c) by propping the first end 14 in an elevated position, lying under the second end 14, and raising the second end 14 further by pressing on the handle 32 with the bottom of the feet.

4. If desired, the pins 34 or the pins 38 could be fitted into the openings in the bar 50. If the pins 34 are employed, the length of the moment arm between the second end 16 and the fulcrum bar 50 is increased, thereby making it easier for the user to raise and lower the second end 16 while applying force to the second end 16. On the other hand, if the pins 38 are employed, the moment arm between the second end 16 and the fulcrum bar 50 is shortened, thereby making it more difficult for the user to raise and lower the second end 16 by applying force to the second end 16.

5. If desired, the user can raise and lower the second end 16 while seated or lying atop the padded board 82. By adjusting the position of the sleeve 90 relative to the post 88, the height of the seat 80 can be adjusted. Further, by releasing the pins 104, the channels 98 can be moved along the runners 62, thereby changing the longitudinal position of the seat 80 relative to the board 12.

6. The padded board 82 can be removed from the sleeve 90 by releasing the pins 94. If desired, the seat 80 can be positioned directly atop the runners 62 (FIG. 7) by removing the telescopic support structure and substituting the seat 80. The channels 84 are of the same size and shape as the channels 98, thereby permitting the seat 80 to be quickly fitted to the runners 62. By using the machine 10 while seated or lying atop the seat 80 in its lowered, runner-contacting position, the user can perform different types of exercises. In particular, by being positioned beneath the raised second end 16, the user can engage in "pull-down" exercises.

7. If the user wishes to perform "pull-up" or "push-up" exercises, the handle 32 can be removed from the bushings 30 and fitted into the bushings 40 at the first end 14. Similarly, the toe bar 70, the seat 80, and the support structure for the seat 80 can be secured to the runners 62 adjacent the first end 14.

8. If the user wishes to perform "dipping" or "pull-up" exercises, then the toe bar 70 can be located in that position shown in FIGS. 9 and 10. In this position, the toe bar 70 holds the first end 14 securely in a lowered position, thereby locking the first end 16 in a raised position. By fitting the second handle 110 to the board 12 as illustrated in FIGS. 9 and 10, the effective height and length of the board 12 is increased, thereby permitting "dipping" and "pull-up" types of exercises to be performed.

From the foregoing, it will be appreciated that the exercise machine according to the invention is compact and durable. It enables a wide variety of exercises to be performed, particulary exercises that benefit the muscles of the back and abdomen. Many of the exercises, such as certain of the leg exercises, are so-called "negative exercises." These exercises are particularly valuable because they exercise muscles that often cannot be developed by known machines.

The various beams and braces used with the invention not only are relatively inexpensive, but they are exceedingly strong. It is expected that many of the components such as the beams, braces, and runners will be made of "box beam" steel members. Such members not only resist flexing, but they are relatively easy to work with and they provide a stable, sturdy structure. Accordingly, the strength and durability advantages found with expensive commercial exercise machines are available in the present invention, while the inexpensiveness and versatility desired in consumer exercise machines also are available.

Although the invention has been described in its preferred form with a certain degree of particularity, it will be apparent that various changes and modifications can be made without departing from the true spirit and scope of the invention as hereinafter claimed. It is expected that the patent will cover all such changes and modifications. It also is intended that the patent shall cover, by suitable expression in the appended claims, whatever features of patentable novelty exist in the invention disclosed.

What is claimed is:

1. An exercise machine, comprising:

a lever defining a longitudinal axis and having first and second ends;

a fulcrum for supporting the lever, the fulcrum being disposed intermediate the first and second ends;

a level base connected to the fulcrum and extending on either side of the fulcrum for supporting the fulcrum in a stable position, the base adapted to lie atop a flat surface;

a selected number of weight plates disposed adjacent the first end of the lever for resisting upward movement of the first end of the lever, the weight plates being disposed only intermediate the fulcrum and the first end of the lever, the weight plates remaining non-rotatably connected to the lever during operation of the machine;

connecting means for connecting the weight plates to the lever; and a handle disposed at the second end of the lever for enabling a user to raise and lower the second end of the lever, the handle extending laterally relative to the longitudinal axis.

2. The machine of claim 1, wherein the lever is in the form of an elongate board having spaced, parallel beams connected by laterally extending braces.

3. The machine of claim 1, wherein the fulcrum is disposed on the underside of the lever, the fulcrum including spaced, vertically extending members disposed on either side of the lever and a laterally extending bar connecting the vertically extending members, the laterally extending bar supporting the lever.

4. The machine of claim 3, wherein the lever is connected to the bar included as part of the fulcrum by means of pins projecting from the underside of the lever, the pins being received in openings formed in the bar.

5. The machine of claim 4, wherein the lever includes spaced sets of pins projecting from the underside of the lever along the longitudinal axis of the lever, the spaced sets of pins enabling the lever to be connected to the fulcrum at different locations along the longitudinal axis.

6. The machine of claim 1, wherein the base is in the form of spaced, parallel runners, the runners being disposed parallel to the longitudinal axis of the lever.

7. The machine of claim 6, further comprising a seat connected to the runners, the seat being movable relative to the lever in order to be positioned adjacent either the first end or the second end of the lever.

8. The machine of claim 7, wherein the seat is connected to the runners by means of a vertically movable post.

9. The machine of claim 8, wherein the seat is removable from the post and is adapted to be positioned directly atop the runners.

10. The machine of claim 6, further comprising a laterally extending, removable bar connecting the runners, the removable bar having means for engaging the first end of the lever and holding the first end in a stationary position relative to the runners.

11. The machine of claim 1, wherein the handle is in the form of a shaft that is removably connected to the lever by means of bushings carried by the second end of the lever.

12. The machine of claim 1, further including a second handle that can be connected to the lever at the second end of the lever for enabling a user to extend the effective length of the lever.

13. The machine of claim 12, wherein the second handle is generally U-shaped and includes spaced arms connected by a bight portion, the bight portion adapted to engage the underside of the lever and the arms adapted to rest atop the handle on either side of the lever so that the arms extend generally parallel to the longitudinal axis of the lever.

14. The machine of claim 1, wherein the weight plates are in the form of a conventional barbell plates, and the connecting means is in the form of a post extending perpendicular to the upper surface of the lever.

15. The machine of claim 14, further including a cap that can be attached to the end of the post.

16. An exercise machine, comprising:

an elongate board defining a longitudinal axis and having first and second ends, the board being in the form of spaced, parallel beams connected by laterally extending braces;

a fulcrum for supporting the board, the fulcrum being disposed intermediate the first and the second ends, the fulcrum being disposed on the underside of the board and including spaced, vertically extending members disposed on either side of the board and a laterally extending bar connecting the vertically extending members, the laterally extending bar supporting the board;

a post connected to the board adjacent the first end of the board, the post projecting from the upper surface of the board;

a selected number of weight plates disposed about the post, the weight plates being disposed only intermediate the fulcrum and the first end of the board, the weight plates remaining non-rotatably connected to the lever during operation of the machine;

a handle disposed at the second end of the board for enabling a user to raise and lower the second end of the board, the handle extending laterally relative to the longitudinal axis; and a level base to which the fulcrum is connected, the base adapted to support the fulcrum in a stable position atop a flat surface, the base being in the form of spaced, parallel runners extending on either side of the fulcrum, the runners being disposed parallel to the longitudinal axis of the lever.

17. The machine of claim 16, wherein the board is connected to the bar included as part of the fulcrum by means of pins projecting from the underside of the board, the pins being received in openings formed in the bar.

18. The machine of claim 16, further comprising a laterally extending, removable bar connecting the runners, the removable bar having means for engaging the first end of the board and holding the first end in a stationary position relative to the runners.

19. The machine of claim 16, further including a second handle that can be connected to the board at the second end of the board of enabling a user to extend the effective length of the board, the second handle being generally U-shaped and including spaced arms connected by a bight portion, the bight portion adapted to engage the underside of the board and the arms adapted to rest atop the handle on either side of the board so that the arms extend generally parallel to the longitudinal axis of the board.

* * * * *